US005328510A

United States Patent [19]

Hofmann et al.

[11] Patent Number: 5,328,510

[45] Date of Patent: Jul. 12, 1994

[54] APPARATUS FOR MAKING PAPER AND PAPERBOARD HAVING ENHANCED GLOSS

[75] Inventors: Leroy C. Hofmann, Saddle River, N.J.; Robert W. Hicks, Warwiek; Jasper H. Field, Goshen, both of N.Y.

[73] Assignee: International Paper Company, Purchase, N.Y.

[21] Appl. No.: 965,559

[22] Filed: Oct. 23, 1992

Related U.S. Application Data

[60] Continuation of Ser. No. 713,473, Jun. 7, 1991, which is a division of Ser. No. 480,434, Feb. 15, 1990, Pat. No. 5,064,692.

[51] Int. Cl.[5] ..... B06C 11/02; D21H 19/00

[52] U.S. Cl. ..... 118/101; 118/106; 118/123; 162/361; 156/238

[58] Field of Search ..... 156/244.24, 244.27, 156/238; 118/100, 106, 108, 123; 162/361

[56] References Cited

U.S. PATENT DOCUMENTS

| | | | |
|---|---|---|---|
| 1,719,166 | 7/1929 | Bradner | 427/372.2 |
| 2,556,078 | 6/1951 | Francis | 156/238 |
| 2,558,791 | 7/1951 | Smith et al. | 156/238 |
| 2,559,649 | 7/1951 | Little | 156/231 |
| 2,631,958 | 3/1953 | Francis | 156/238 |
| 2,934,467 | 4/1960 | Bergstein | 156/231 |
| 2,944,586 | 7/1960 | Yanulis | 156/498 |
| 3,192,893 | 7/1965 | Bauer et al. | 118/69 |
| 3,230,126 | 1/1966 | Craver, Jr. | 156/244.27 |
| 3,336,862 | 8/1967 | Brundige et al. | 100/162 |
| 3,432,373 | 3/1969 | McMahon | 156/184 |
| 3,507,733 | 4/1970 | Davidson | 156/247 |
| 3,689,347 | 9/1972 | Reinhall et al. | 156/289 |
| 3,849,226 | 11/1974 | Butz | 156/247 |
| 3,873,390 | 3/1975 | Cornell et al. | 156/238 |
| 3,980,512 | 9/1976 | Rauser | 156/231 |
| 4,059,471 | 11/1977 | Haigh | 156/244.27 |
| 4,113,894 | 9/1978 | Koch, II | 427/44 |
| 4,153,494 | 5/1979 | Oliva | 156/230 |
| 4,255,217 | 3/1981 | Franze | 156/230 |
| 4,256,034 | 3/1981 | Kusters et al. | 100/38 |
| 4,289,559 | 9/1981 | Murphy | 156/238 |
| 4,308,320 | 12/1981 | Schiller | 428/511 |
| 4,349,402 | 9/1982 | Parker | 156/233 |
| 4,391,833 | 7/1983 | Self et al. | 426/523 |
| 4,462,852 | 7/1984 | Custor | 156/231 |
| 4,473,422 | 9/1984 | Parker et al. | 156/233 |
| 4,613,393 | 9/1986 | Cattanach et al. | 156/323 |
| 4,664,734 | 5/1987 | Okita et al. | 156/231 |
| 4,929,474 | 5/1990 | Avni et al. | 427/326 |
| 4,978,560 | 12/1990 | Stone | 427/366 |

OTHER PUBLICATIONS

"Coating Equipment and Processes", Chapter 17 by G. L. Booth, Lockwood Publishing Co., N.Y., (1970), pp. 173–184.

*Primary Examiner*—W. Gary Jones
*Assistant Examiner*—Steven P. Griffin
*Attorney, Agent, or Firm*—Ostrager, Chong & Flaherty

[57] ABSTRACT

A method and apparatus for producing a paper product having a surface with enhanced gloss. The method includes the following steps: applying a continuous layer of an impressionable coating material to a paper product; contacting the layer of coating material with a polymer release film having a smooth and glossy surface substantially free of defects, the surface having non-adhering and release characteristics; and solidifying the coating material during contact with the release film. Using this technique, a smooth and glossy surface of the release film is substantially imparted to a surface of the layer of solidified coating material. In the case of clay-coated substrates, the coating is solidified by heating, whereas in the case of polyethylene-coated substrates, the coating is solidified by cooling. The end product is a coated substrate in which the coating has a glossy surface to which the texture of a film has been imparted.

24 Claims, 14 Drawing Sheets

APPARATUS FOR MAKING PAPER AND PAPERBOARD HAVING ENHANCED GLOSS

This is a continuation of copending application Ser. No. 07/713,473, filed Jun. 7, 1991, which is a division of application Ser. No. 07/480,434, filed on Feb. 15, 1990, now issued as U.S. Pat. No. 5,064,692.

FIELD OF INVENTION

This invention generally relates to an apparatus and method for making paper and paperboard having a gloss-enhanced surface and to the product produced thereby. More specifically, the invention concerns techniques for enhancing gloss of coated papers and paperboard products which effect processing efficiencies not heretofore achieved in the art.

BACKGROUND ART

The quality of paper is determined by its smoothness and sheen. Smoothness is a measure of the evenness of paper surfaces. Sheen is a measure of the homogeneous optical reflectivity of paper, and denotes a range of characteristics from "high gloss" to "matte."

Enhancement of gloss characteristics is desirable for diverse paperboard and paper applications and for this purpose it is conventional to coat paper with various formulations including clay compositions and polyethylene. Clay formulations have particular application in papers used in publishing; polyethylene is conventionally employed in finishing paperboard used for liquid packaging of food products.

In the prior art, calender and supercalender apparatus have found wide application in the finishing of coated paper stock. In conventional gloss calenders coated paper is acted upon by polished cylinder surfaces under pressure and heat to impart gloss to the coated surface. This technique is not entirely satisfactory in that it densifies the paper in areas of nonuniformity in paperboard thickness diminishing the ink absorbency of the board for printing applications.

To overcome this deficiency in gloss calendering, the art has employed supercalender apparatus which include stacks of hard and resilient cylinders which cooperate to smooth and impart a uniform thickness through application of pressure. See U.S. Pat. No. 4,256,034. However, this technique further densifies the coating with a consequent reduction in paper printability. Moreover, such supercalenders require extensive tooling and capital investment which increase paper production costs.

In another conventional approach, "cast coating" processes are employed in which highly polished casting cylinder surfaces coact with an arrangement of coating rollers to impart a uniform finish to paper. Such a conventional process is disclosed in "Coating Equipment and Processes", Chapter 17, by G. L. Booth, Lockwood Publishing Co., New York (1970) which Identifies U.S. Pat. No. 1,719,166 to Bradner as an early patent in this field. Bradner discloses a process in which the coating surface, while in a plastic (i.e., molten) state, is contacted by a non-adhering high gloss surface and then cured. Use of a nonadhering surface permits release of the paper following the curing operation. This technique has application for use in the polymer coating of plastics which are molten and solidify when cooled, as well as clay coatings which change from a plastic to a solid state by application of thermal heat.

Highly polished metal surfaces employed in conventional cast coating processes impart a high-gloss surface to the paper without the densification associated with supercalendering techniques. Thus the coating has greater bulk and ink absorbency than is obtained by supercalendering.

In the case of clay coatings, the clay formulation is applied to one side of a paper substrate and that side is then pressed against a heated, highly polished surface of a cylinder until the coating dries. When the paper is released from the drying cylinder, the coating has a surface which mirrors the polished surface of the drying drum.

Conventional cast-coating paper formulations are similar in content to those employed in high-grade coated paper applications. However, the adhesive ratio in a cast coating is higher than for supercalendered coated paper. This increase in adhesiveness counters retention forces on the cast surface associated with separation of the paper from the casting surface and enhances the ink holding capability of the coating. Although excessive adhesive in non-cast-coated paper impairs the gloss and smoothness of the paper after calendering, high levels of adhesive in cast-coated paper has the opposite effect, that is, gloss enhancement.

Another conventional type of cast coating is referred to as cast calendering. This technique entails the production of a high gloss on supercalendered coated paper by rewetting the surface of the densified coating and then contacting the wetted surface with a highly polished, metal heated roll under pressure.

In the case of polymer coatings, cast coating entails the steps of applying polymer coating to a casting surface such as a stainless steel belt or coated casting paper and then transfer laminating the polymer coating to the substrate. FIG. 1 illustrates a prior art apparatus for application of a polymer coating to a substrate using a specially coated casting or release paper.

Although cast coating imparts satisfactory gloss to paper, the high expense associated with the process limits its application to high cost paper or paperboards. It will be appreciated that the process is relatively slow and requires exacting tolerances in the coaction of the applicator rolls and casting surface. Such requirements increase production costs.

Various prior art U.S. patents teach the use of a band or belt to impart surface characteristics to a coated substrate. For example, U.S. Pat. No. 4,153,494 to Oliva discloses a process for obtaining a shiny metallized surface on a plated or laminated material by coating the surface with varnish and applying a plastic film which has been covered with a metallizing agent. "The film acts as both a carrier and a glossing element . . . ." See Oliva patent Abstract. Further, U.S. Pat. No. 4,664,734 to Okita et al. discloses a process for producing a magnetic recording medium, wherein a magnetic coating composition is coated on a roller or band having a mirrored surface to form a smooth magnetic surface layer on a non-magnetic substrate. Finally, U.S. Pat. No. 4,059,471 to Haigh discloses a method of transfer dying utilizing a polyethylene-coated heat transfer paper to transfer the dye.

There is a need in the art for apparatus and processes for gloss enhancement of coated papers which are less complex in tooling requirements than known in the art. Technology is required which has diverse application for gloss enhancement of high grade printing paperstock as well as paperboard for packaging applications. Such enhancement should preferably be obtained without undue compaction of paperstock with associated diminishment in printability.

Accordingly, it is a broad object of the present invention to provide an improved gloss enhancing process and related apparatus for production of coated paper and paperboard.

A more specific object of the invention is to provide a gloss enhancement process having application for coating paper and paperboard with clay composition or polyethylene coatings.

Another object of the invention is to provide a gloss enhancing process for fabricating novel coated paper and paperboard products having improved printing characteristics.

A further object of the invention is to provide a gloss enhancing production line apparatus and processes which are less complex, obtain faster production speeds, and are improved over the prior art.

DISCLOSURE OF THE INVENTION

In the present invention, these purposes, as well as others which will be apparent, are achieved generally by providing a method which includes the steps of: applying a continuous layer of coating material on a substrate, the coating material being in an impressionable state; contacting the layer of coating material with a polymer release film having a smooth and glossy surface substantially free of defects, the surface having non-adhering and release characteristics; and drying or cooling the coating material during contact with said release film. Using this technique, the image of a smooth and glossy surface of the release film is substantially imparted to a surface of the layer of solidified coating material. In the case of clay-coated substrates, the coating is set or cured by heating, whereas in the case of polyethylene-coated substrates, the coating is set or cured by cooling.

An apparatus in accordance with the invention for carrying out the foregoing method is disclosed which comprises: means for applying a continuous layer of deformable coating material, means for solidifying the layer of deformable coating material, the solidifying means having a zone in which solidification occurs; means for placing the substrate with the layer of coating material applied thereon within the zone; and means for contacting the layer of coating material with a smooth surface of a release film while the layer of coating material is within the zone. The release film has a smooth and glossy surface substantially free of defects, which surface has non-adhering and release characteristics. In the case of clay-coated substrates, the solidifying means comprises an oven as a source of heat. In the case of polyethylene-coated substrates, the solidifying means comprises a chilling roll.

In accordance with the invention, the deformable layer of coating material is applied between the substrate and the release film. The portions of the substrate and release film with coating material therebetween are pressed together due to the tension exerted on the substrate and film by the rolls. One side of the coating layer adheres to the substrate, while the other side has the texture of the release film substantially imparted thereon during curing. The end product is a coated substrate in which the coating has a glossy surface.

Other objects, features and advantages of the present invention will be apparent when the detailed description of the preferred embodiments of the invention are considered in conjunction with the drawings, which should be construed in an illustrative sense.

BEST MODE FOR CARRYING OUT THE INVENTION

Figure 1:
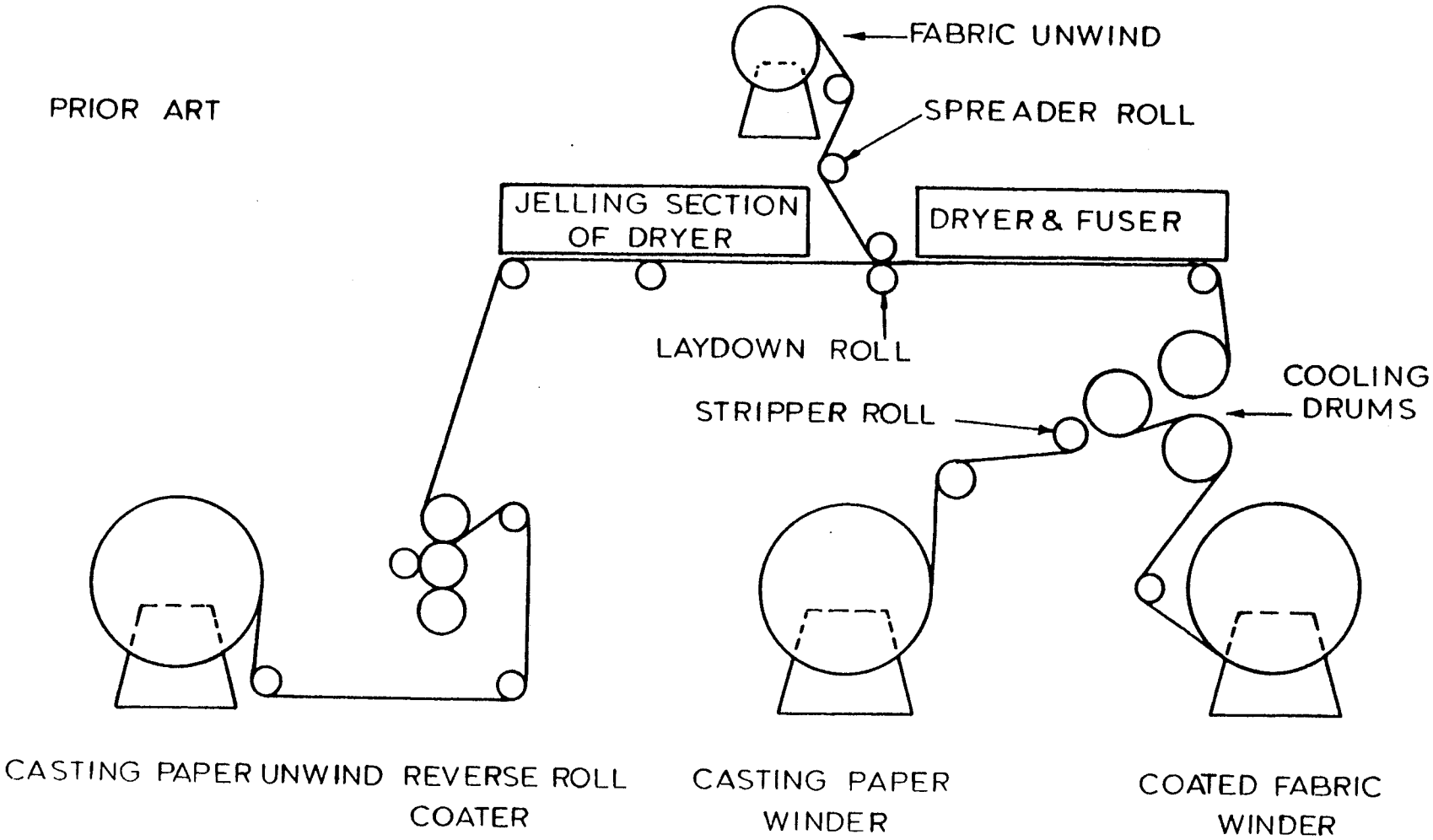
PRIOR ART FIG. 1
FIG. 1 is a schematic view of a conventional apparatus for cast coating using a specially coated release paper.
Figure 2:
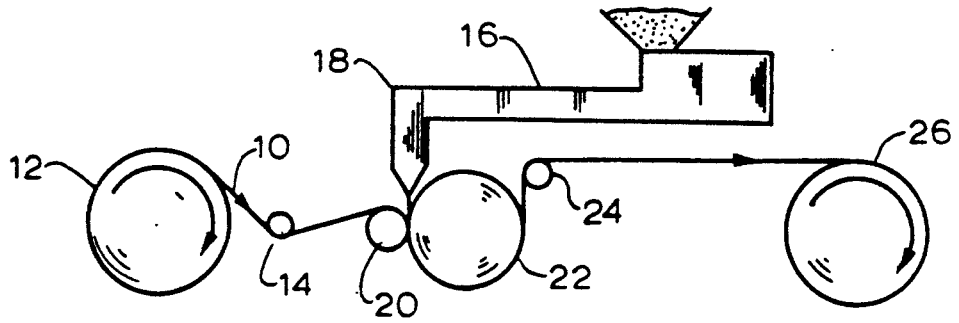
FIG. 2 PRIOR ART
FIG. 2 is a schematic view of a conventional apparatus for enhancing the gloss of a polyethylene-coated paper product using a highly polished chill roll.

It is well known to enhance the gloss of a surface of a polymer-coated product, that is, paper or paperboard. FIG. 2 illustrates a conventional polymer extrusion coating apparatus for gloss enhancement of paper or a paperboard substrate 10. Polymers for use in extrusion process are preferably blended and pelletized prior to application. The substrate 10 which is supplied via supply rolls 12, 14 is advanced to an extruder 16 and die 18 for application of the polymer coating. Solidification of the polymer coating is obtained by then passing the substrate through pressure and chill rolls 20, 22.

For a polymer comprising polytetramethylene terephthalate, the chill roll is preferably maintained at a temperature in the range of 60° to 100° F. The functions of the chill roll are to: (1) form a nip with the pressure roll for joining the substrate and the molten polymer layer under pressure; (2) remove heat from the polymer coating and the substrate; and (3) impart the desired surface finish to the polymer coating. Preferably the nip pressure applied to the coated substrate by chill and pressure rolls 22, 20 is approximately 50 to 350 lbs. per linear inch of web width. Finally, the heat-resistant paper product is passed from the chill roll 22 via roll 24 to storage roll 26.

In the case where the polymer is polyethylene (PE), the gloss achieved by the foregoing conventional process is customarily in the range of 50–60% as measured by standard T 480 om-85 of the Technical Association of the Pulp and Paper Industry ("TAPPI"), Technology Park, Atlanta, Ga. It will be recognized that higher surface gloss is desirable for PE-coated paper product to enhance printability and for aesthetic effect.

Normally, surface smoothness and gloss are largely dependent on the chill roll surface. To achieve higher gloss than the customary 50–60% with PE-coated substrates, the chill roll 22 must be highly polished. Such polished chill rolls produce gloss levels as high as 90%. However, considerable additional paper production costs are associated with tooling and line processing required to achieve higher gloss levels.

In the present invention gloss levels of 90% or more are obtained without requirement of conventional highly polished chill rolls. In accordance with a preferred embodiment of the invention, a very smooth, strippable polymer film is disposed between the chill roll and molten PE extruded onto paper or paperboard substrate. Upon curing of the PE and stripping of the film, the substrate is imparted with superior surface characteristics of the polymer film.

Figure 3:
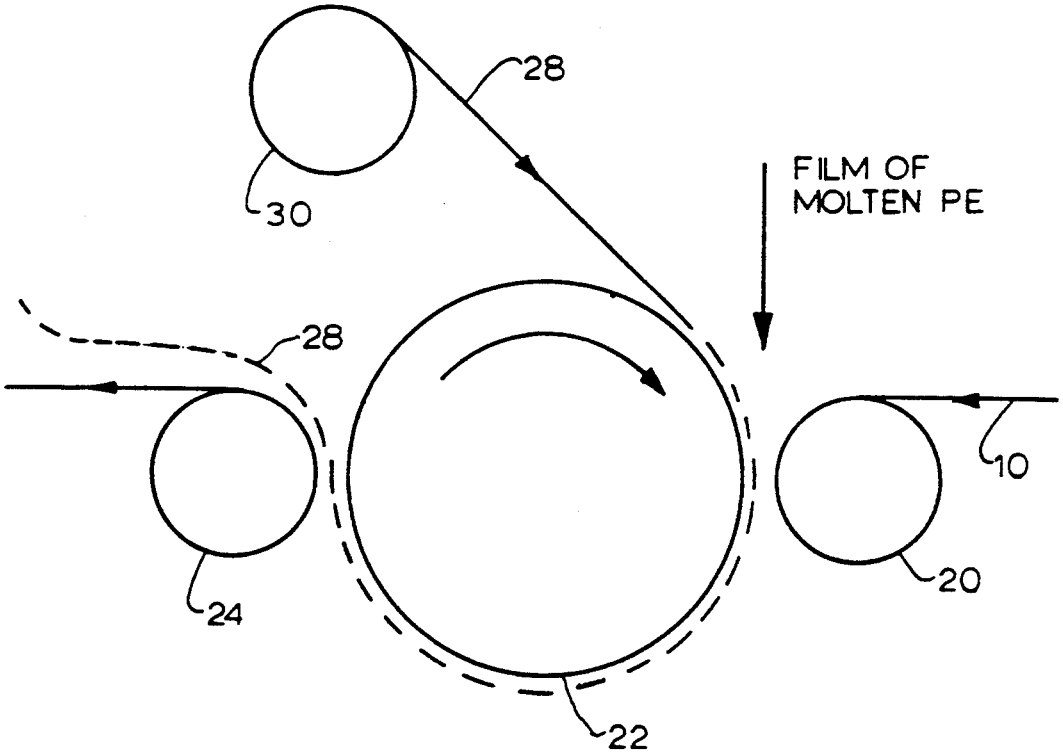
FIG. 3 is a schematic view of an apparatus in accordance with the invention for enhancing the gloss of Polyethylene-coated paper.

An apparatus in accordance with this first preferred embodiment is depicted in FIG. 3. As in the conventional apparatus of FIG. 2, the preferred embodiment has means (not shown in FIG. 3) for applying molten PE onto the substrate 10. The substrate with molten PE applied thereon is passed through pressure and chill rolls 20, 22. In contrast to the conventional apparatus of FIG. 2, wherein the layer of molten PE coating is in direct contact with the surface of chill roll 22, a polymer release film 28 is disposed between the layer of molten PE and the chill roll surface.

In one embodiment the release film is unwound from a supply roll 30, passed first through the nip between pressure and chill rolls 20, 22 and then through the nip between roll 24 and chill roll 22, stripped from the PE-coated substrate, and wound onto a winding roll (not shown). In accordance with another embodiment, the polymer release film is provided in the form of a continuous belt as will be described in more detail hereinafter. See FIG. 6.

Advantage in the invention is obtained by placement of the polymer release film 28, which has a glossy surface, between the surface of the chill roll 22, and molten PE coated substrate 10. Glossy surface characteristics of the release film are imparted to the PE coating when it solidifies.

The efficacy of the invention process was demonstrated in trials on a pilot extruder using rolls of smooth oriented polypropylene (OPP) release film. A coater was run under normal operating conditions to coat PE on boards which in turn were disposed in contact with the release film. Following solidification of the PE coating, the OPP film was stripped from the boards. As compared to control samples coated without application of the film, the test samples exhibited marked gloss enhancement, improved smoothness and higher coefficients of friction. Interesting, the enhancement was also obtained in boards coated with reduced weights of PE.

In first and second trials standard International Paper Company milk carton stock (200 lb/3000 $ft^2$ basis wt., 12 lb coating wt./3000 $ft^2$) and 20 pt, 0.020 in. VAL-U-COAT® clay-coated paperboard were used as the basestock. For the first trial, a 1-mil single-ply OPP film was used as the release film. In the second trial, a 1-mil laminated OPP/PVDC (oriented polypropylene/-polyvinylidene chloride) film was used, with the OPP side facing the PE coating.

Conventional operating procedures and speeds were used on a conventional extruder, manufactured by Black Clawsen Co., Middletown, Ohio, except that a roll of release film was fed continuously between the chill roll and the PE-extruded coating as shown in FIG. 3. The release film was later removed from the substrate when the finished rolls were unwound for examination. An electrostatic (corona) treatment unit, generally employed following extrusion coating, was turned off during trial runs for convenience. Satisfactory ink adhesion was evident even without corona treatment. Operating data for these trials are set forth in an Appendix hereto, Table I.

Physical measurement data concerning the experimental boards (after removal of the OPP release film) are set forth in Table II. Enhancement in paper gloss levels was plainly visible to the naked eye. Gloss values (TAPPI Standard T 480 om-85) were, on average, 70% higher processed as compared to control board samples. For the VAL-U-COAT® clay-coated paperboard run, even when the PE coating weight was reduced from 7.3 to 5.6 lb (compare run 9853 vs. 9854), a gloss above 90% was maintained. Gloss measurements were made employing a GARDNER brand glossometer, multi-angle model GG-9092, manufactured by Gardner Lab Inc., Bethesda, Md.

Processed board also exhibited enhanced smoothness. A "Parker" smoothness apparatus, model PPS-78, manufactured by H. E. Messmer Ltd., London, England was employed to measure smoothness. Parker print surface smoothness values were reduced in processed board an average of 20%, reflecting enhancement in print smoothness. Improvement in printability was also evident in boards processed on the pilot extruder.

Further advantage in the invention process was obtained in the finding that processed boards exhibited higher coefficients of friction (COF) than conventional unprocessed boards. Higher COF were obtained in PE-to-PE test data. It will be recognized that this result is advantageous in that it facilitates stacking of boards in production line coating processes.

Thus, initial trials on the pilot extruder yielded marked improvement in gloss characteristics in board processed in accordance with the invention. High gloss (above 90%) was achieved without requirement of a highly polished chill roll, even at reduced coating weights. Surface smoothness and the COF values were also increased. Through the use of a smooth and strippable release film between the chill roll and the extruded PE coating, gloss and smoothness were respectively improved 70% and 20% in application to VAL-U-COAT® paper and milk carton basestock.

As will be discussed more fully hereinafter, commercial apparatus for practicing the invention may be provided which employ continuous reusable film belts See FIGS. 6–8 In polymer coating applications, particular advantage may be obtained through use of a chill roll which includes a film covering.

Figure 4:
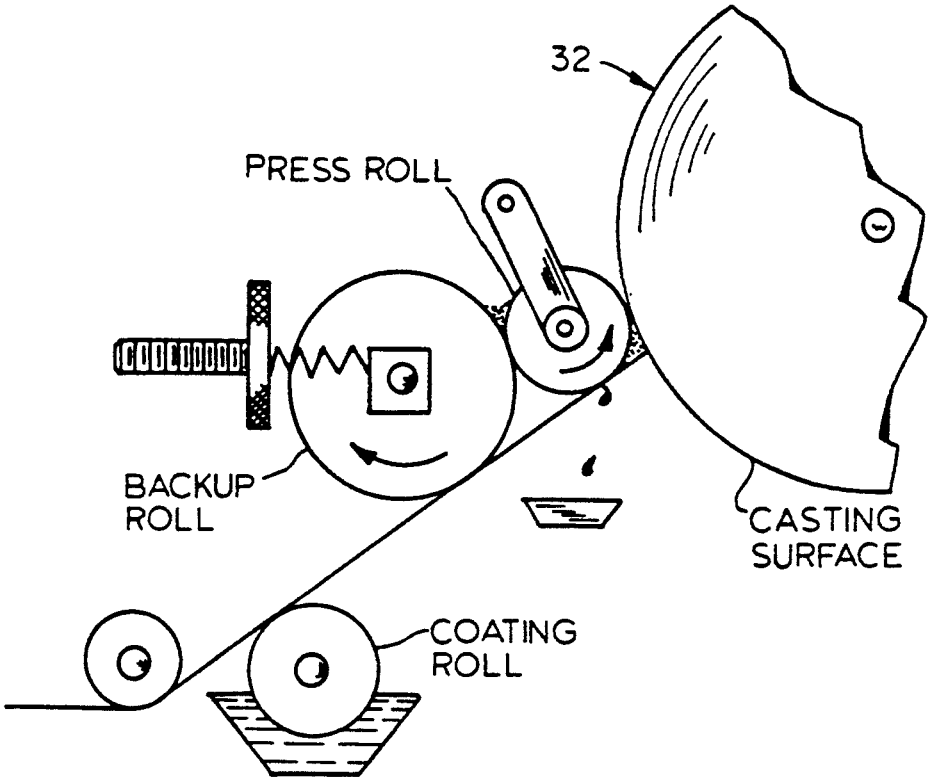
FIG. 4 PRIOR ART
FIG. 4 is a schematic view of a conventional apparatus for enhancing the gloss of clay-coated paper product using a highly polished chrome-coated roll.

Attention is now directed to clay paper apparatus and processes of the invention. In accordance with conventional teachings, very high gloss (85–90%) on the surface of a clay-coated substrate can be achieved only by cast coating (see FIG. 4) using a highly polished chrome-coated roll 32. However, cast coating is a relatively slow and costly process. Conventional techniques and apparatus for cast coating are described in detail in Chapter 17 of "Coating Equipment and Processes" by G. L. Booth, Lockwood Publishing Co., New York (1970), which is specifically incorporated herein by reference.

Following successful trials of the invention in connection with PE-coated board, further experimentation demonstrated that the invention has application in the coating of clay composition to paper and paperboard. Trials for such applications were run on a 12" laboratory bench top coating apparatus manufactured by Modern Metal Craft, Inc., Midland, Mich. under the brand designation MM, model 76-A. The coater was modified to provide a mechanism for interfacing release films with coated paperstock drying drums. See FIG. 5.

Trials were run employing International Paper Company MOSS POINT brand label stock (60 lb), No. 2 clay coating, and various polymer release films.

A variety of release films, representing various polymer types and film thicknesses, were selected for investigation including films fabricated of polyester, polyamide, fluoropolymer and trimethylpentane as well as polymer-coated papers. Criteria for selection of the release films included requirement that the films have excellent surface smoothness, release properties, adequate heat resistance (above 150° C.) and tensile strength. Film calipers ranged from 2–10 mil (0.002 to 0.01 in.). Table III sets forth physical properties of the films, commercial sources and brand designations.

The No. 2 clay formulation employed in the trials, which is representative of conventional coating materials, had the following formulation:

| Ingredient | Brand Designation | Solids, % | Wet Wt., g |
|---|---|---|---|
| No. 2 clay | | 72 | 2080 |
| latex binder | Polysar 1138 | 46 | 450 |
| Supplier: | BASF, Charlotte, North Carolina | | |
| calcium stearate (lubricant) | Suncote 450 | 49 | 30 |
| Supplier: | Sequa Chemical Co. Chester, S. Carolina | | |
| acrylic emulsion | Alcogum L-15 | 29 | 15 |
| Supplier: | Alco Chemical Co. Chattanooga, Tennessee | | |
| 50% NaOH (pH adjuster) | | | 8 |
| Total formulation solids: 67% | | | |
| Formulation pH: 9 | | | |

Formulation viscosity was measured employing a Brookfield viscometer, Brookfield, Engineering Laboratory, Inc., Stoughton, Mass. Viscosity measurements were as follows: 2300 cP at 100 rpm and 7200 cP at 20 rpm (Spindle No. 5, standard calibration—liquids and oil).

Figure 5:
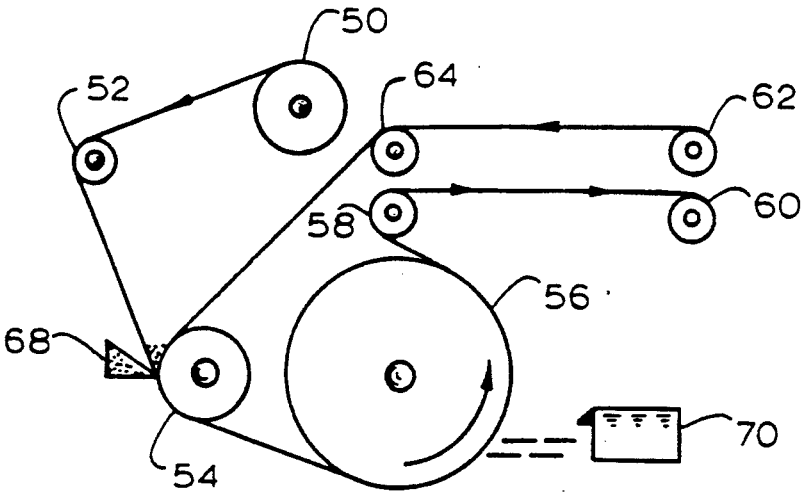
FIG. 5 is a schematic view of an apparatus in accordance with the invention for enhancing the gloss of clay-coated paper which employs a release film.

FIG. 5 illustrates the modified coating apparatus employed in the invention. Initially, the rolls of release film were fed continuously to the coater and rewound following processing. In accordance with this embodiment the substrate is unwound from take-off roll 50 and passed in sequence around roll 52, between coating blade 68 and roll 54, around drying drum 56 and roll 58, and then wound onto wind-up roll 60. At the same time the release film is unwound from takeoff roll 62, passed around roll 64 and between coating blade 68 and roll 54, where it contacts the layer of clay coating compound applied on the substrate by coating blade 68. The clay coating is solidified when the substrate/coating/release film lamination passes around drying drum 56, where it is exposed to the heat from the hot drum 56 and the hot air blower 70 at temperatures and time periods sufficient to cure the clay coating. The smooth surface of the release film imparts a high-gloss surface to the clay coating as it solidifies. Thereafter, the web is wound onto wind-up roll 60 via roll 58.

Conventional operating conditions for the bench top coater are 500 fpm with a loading on the coating blade of 250 g. It was determined that the loading specifications had to be increased well above 250 g to achieve normal pick-up of 10–15 lb clay/3000 $ft^2$, and that lower machine speeds plus auxiliary hot air blowers were necessary to ensure adequate drying.

In later trials, continuous belts of the polymer release films were used instead of rolls. FIGS. 6–8 show the arrangement of this preferred embodiment. The path of the substrate is substantially the same as that shown in FIG. 5. However, in the embodiment of FIG. 6, the release film takes the form of a belt 72 rotatably supported by the backing roll 54 and the drying roll 56. A tension roll 55 is provided to compensate for stretching which occurs in the belt during use. The belts were made by splicing cut ends together with tape. An additional infrared unit was installed under the dryer roll 56 to augment drying capacity.

Figure 6:
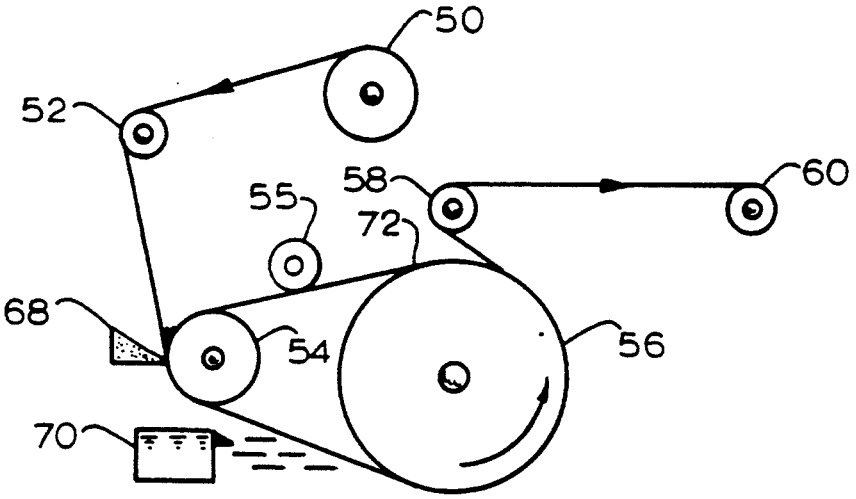
FIG. 6 is a schematic view of an alternative embodiment of the apparatus of the invention for enhancing the gloss of clay-coated paper wherein the release film is provided in the form of a belt.
Figure 7:
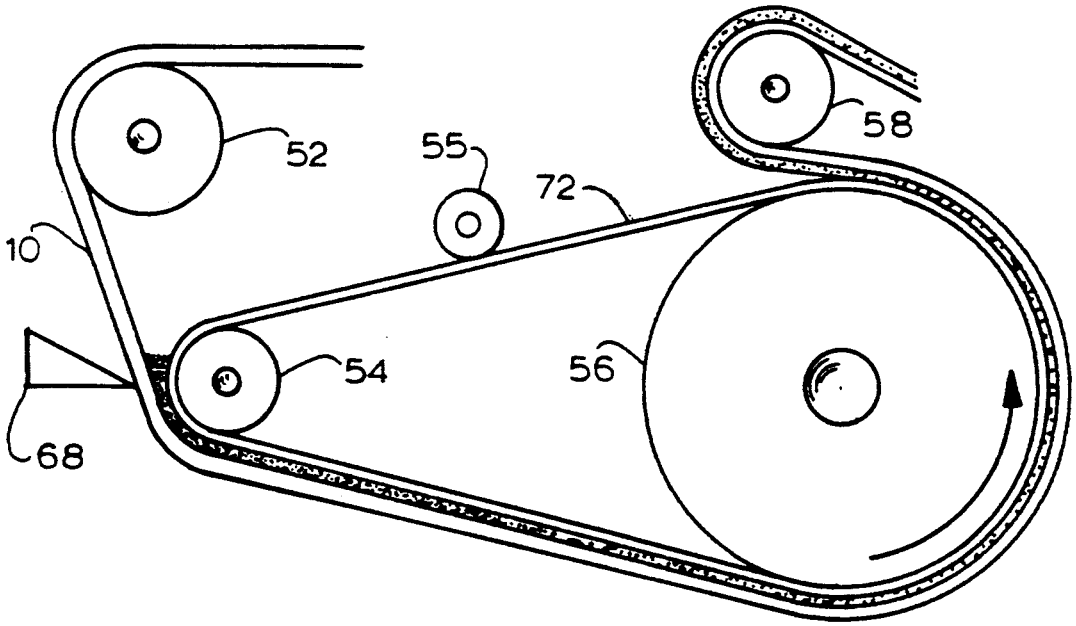
FIG. 7 shows in greater detail the clay coating application and solidifying means of the embodiments depicted in FIGS. 5 and 6.

FIG. 7 shows a portion of FIG. 6 on an enlarged scale. As illustrated in FIG. 7, the deformable clay formulation is applied, using a coating blade 68, between the paper substrate 10 and the release film belt 72. As each portion of the layer of clay formulation is rolled around the drying roll 56, the surface structure of the release film is impressed onto the impressionable surface of one side of the clay layer and then the heat supplied by hot air blower 70 (see FIG. 6) solidifies the clay formulation. Thus, when the release film is stripped from the clay coating, the surface of the clay coating has the surface structure of the release film imprinted thereon.

Figure 8:
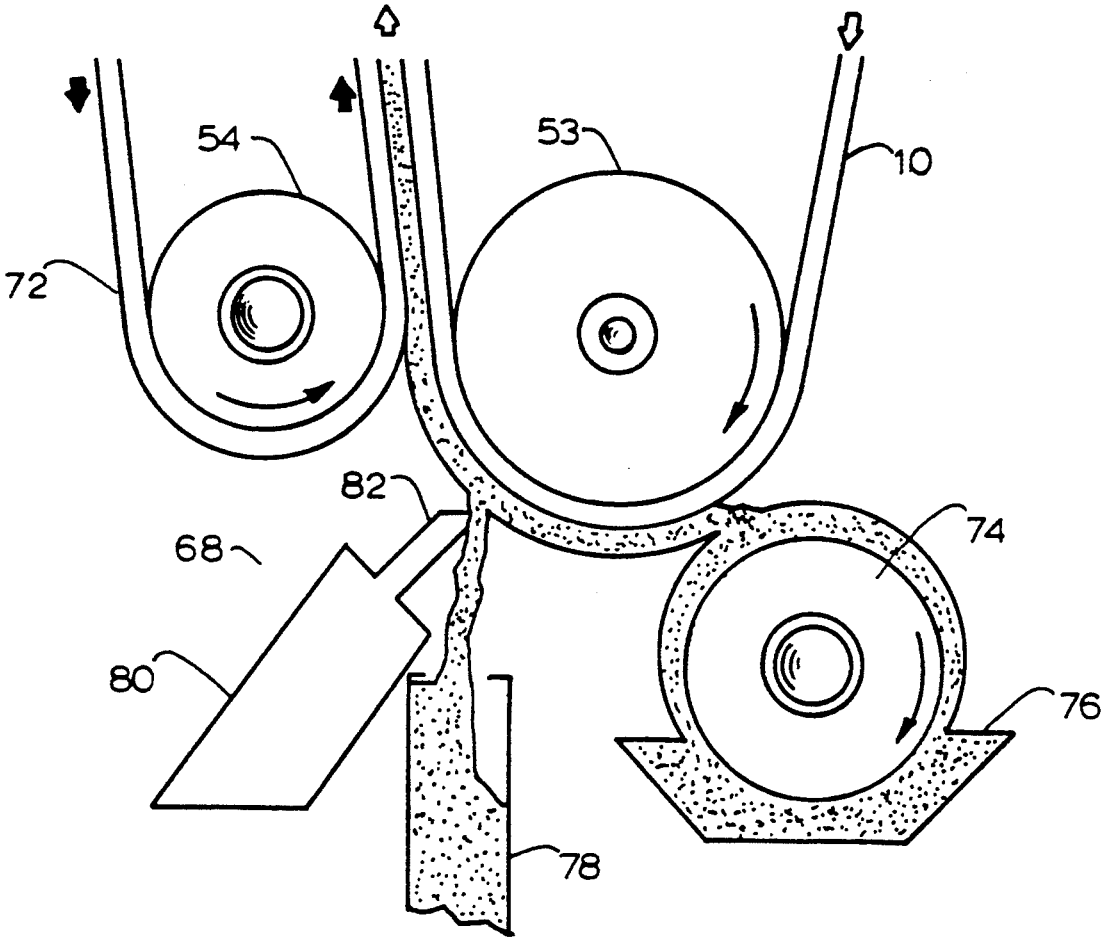
FIG. 8 illustrates the clay coating application means in accordance with another embodiment of the invention.

FIG. 8 shows a detailed view of the means 68 for applying the deformable clay formulation on the substrate in accordance with another embodiment. The applicator roll 74 is rotatably arranged such that its circumferential surface dips in a coating pan 76 filled with clay formulation. The deformable clay material adheres to the roll surface, is carried toward and brought into contact with the surface of substrate 10, and upon contact adheres to the substrate. Depending on the desired thickness of the clay formulation, the blade 82 of the metering device 80 is preset to remove excess clay, leaving a layer of desired thickness on the substrate. The excess clay falls into coating return receptacle 78.

It was determined that a speed of 15 fpm and blade loading of 1500 g yield generally acceptable runnability and clay pick-up levels with the release films. Therefore, these conditions were adopted as "standard" for purposes of comparing the various films or belts under identical conditions. Samples of the resulting coated papers were tested for clay pick-up, smoothness and gloss. Control samples were coated in a conventional manner, but without use of a release film. As is normally done with clay-coated papers, most of the control samples were calendered (2 nips, 80 psi, 150° F.) whereas the experimental papers were not. (Calendering, of course, improves smoothness and gloss.)

Two techniques were employed to measure smoothness of the polymer release films: a Parker Model P-78 Print-Surf Roughness Tester, manufactured by H. E. Messmer Ltd., London, England, and a profilometer developed by International Paper Company. Both sides of the film were measured (in each direction, x and y, in the case of the profilometer) and the averages taken. For those release films made from silicone or polymer-coated films or paper, only the coated side was measured.

In the Parker test, roughness (or smoothness) is sensed by leakage of air between the surface of the sample and the precision capped edge of a sensing head.

Figure 9:
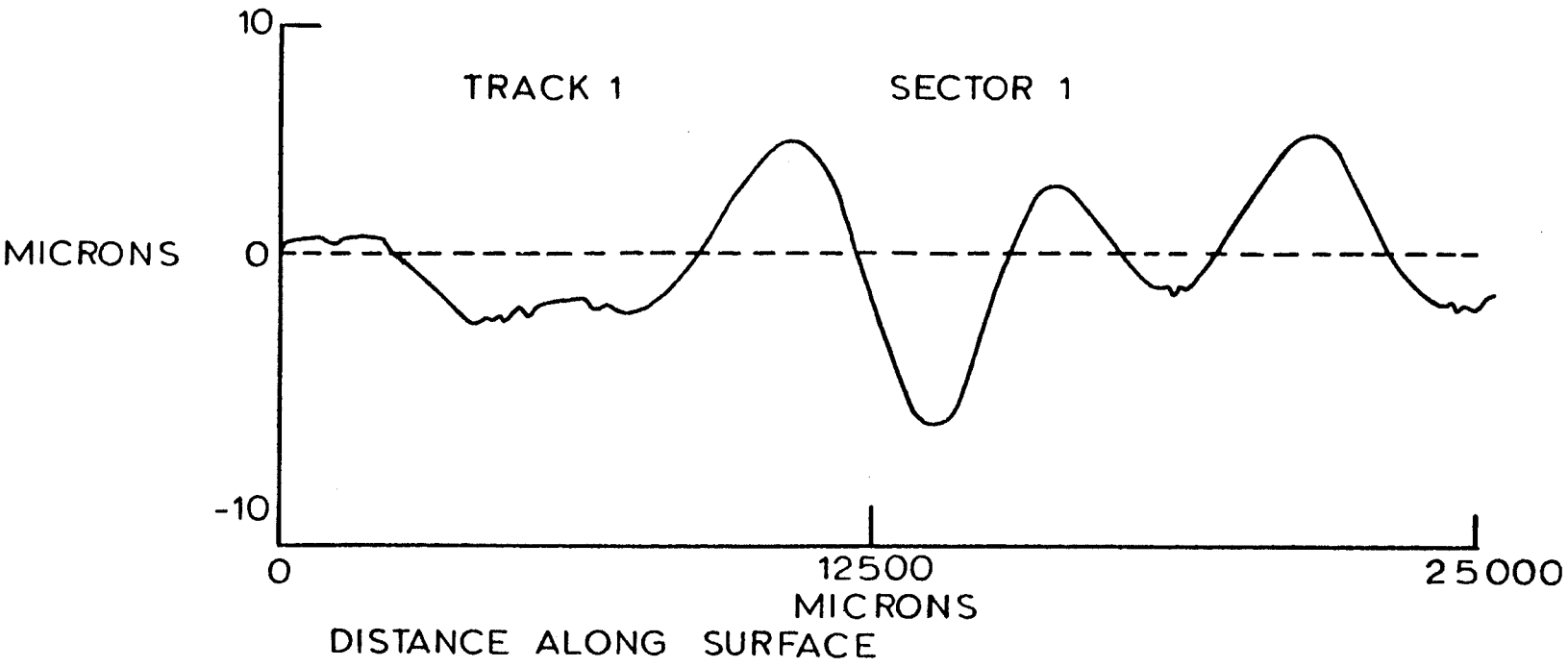
FIG. 9 is a graph of the surface smoothness of the polymer release films tested during experimentation.

The profilometer is designed to provide a direct measurement of the release film smoothness. In the profilometer, a stylus is connected to a transducer and mounted over a computer-controlled x-y movable sample holder. A piezoelectric sensor housed in the holder tracks film smoothness in all directions over a 4-inch square piece of the film. A typical tracing over polymer films is shown in FIG. 9. Overall film smoothness, for convenience, is expressed as one number, a "Profilometer Smoothness Number." This number is arbitrarily taken as the average standard deviation from the mean of all the peaks and valleys traced out by the stylus for each film sample.

For the experimental high-gloss coated paper samples made on the top bench coater, the coating smoothness was measured by the Print-Surf roughness tester, previously described, which measures paper and board smoothness.

Data concerning release characteristics of films investigated in laboratory "draw down" and bench top coater trials was taken through visual observation. See Table IV.

Particulars concerning the bench top coater apparatus are set forth above. In laboratory draw down trials 5×12 inch paper stock samples were coated with a cross width strip of the liquid clay suspension. Then, using a glass coating rod, the coating was "drawn down" the length of the paper to form a thin clay coating. A 5-inch-square piece of polymer film was placed on top of the clay coating and pressed lightly with a blotter, and the paper was then dried in an oven at 95° C. for one minute. The ease or difficulty in manually removing the polymer film from the dry coating was noted. The tendency of the coating to adhere to the film in the bench top coater trials was similarly noted following drying of the coating.

In addition to visual observations, the contact angle of the films with distilled water was measured using a Rame-Hart Model A-100 goniometer, manufactured by Rame-Hart, Mountain Lakes, N.J., to test whether the contact angle correlated with release properties.

The physical properties and performance characteristics of the release films, as they relate to smoothness, clay release, heat resistance and toughness, are shown in Table III and summarized qualitatively in Table IV.

Referring to Table III, it can be seen that the all-polymer films had lower "Profilometer Smoothness Numbers" than the Thilmany Pulp and Paper Company coated papers (1–4 vs. 5–6), indicating that the polymer films had less "peak and valley" variation and were thus presumably smoother. However, the Print-Surf test did not correlate well with the Profilometer Smoothness Numbers. The Parker test is designed for paper and board, and may need special adjustments for polymer surfaces. It is believed that softer polymer films effectively sealed off escaping air from the sensing head, resulting in erroneous data. Attention is directed to the profilometer readings which provide an accurate measure of film smoothness.

In general, release properties in the films correlate with film-coating contact angle. Clay coatings adhere strongly to MYLAR polyester and KAPTON polyamide films which both have relatively low contact angles of approximately 70°. In contrast, silicone-coated MYLAR, which has a 90° contact angle showed acceptable release characteristics.

Films investigated in the trials also exhibited satisfactory heat resistance and toughness in use. Thus, in the bench top coater trials there was no excessive softening or tensile failure in the films. For completeness, it is noted that TPX trimethylpentane exhibited a slight softening, as did TEFLON fluorocarbon which has a characteristically high service temperature.

Although polymer films employed in the trials exhibited high toughness (Tensile Energy Absorption, TEA) and other physical strength values, they were also found to stretch to a considerable extent. Accordingly, in commercial applications of the invention, which employ continuous film operations, stretch characteristics of the release film must be taken into account. Pre-stretching of the release film prior to use maintains required stretch tolerances in continuous commercial applications.

Table V sets forth bench top coater specifications for trials employing different polymer films of the invention. In the trials a bench top coater was employed in conjunction with non-continuous film release materials, i.e., non-belted films. Each figure represents the average of at least two separate trial runs. Each film was compared under identical "standard conditions" as previously described (15 fpm, 1500 g blade loading). Control samples processed under like conditions without use of a release film exhibited low clay pick-ups, as expected. However, controls were also run under normal conditions (40 fpm, 250 g loading) to achieve the same target clay pick-up. At similar clay loadings of 10–15 lb/3000 $ft^2$, all polymer release films (uncalendered) yielded gloss levels of 90% or higher, compared to 60% for the calendered controls. Release films or belts fabricated of Thilmany Pulp and Paper Company coated papers (SCOTCHBAN Teflon-coated paper, 84 C1S polyethylene and silicone-coated paper) yielded lower levels of gloss enhancement. It should be noted that the films employed in the trials were characterized by relatively low smoothness (i.e., high profilometer numbers) and high gloss.

EXAMPLES I-III

The Examples represent draw down trial runs in accordance with the procedures described below, employing 12 and 18 PT paperboard, 7 and 10 mil MYLAR polyester release films, and the No. 2 clay formulation. FIGS. 11-23 are photomicrographs of MYLAR polyester films, and control and processed paperboard which illustrate the gloss enhancement obtained in the invention. For examination purposes, the control and processed paperboards were titled at a 45° in the photomicrographs.

Figure 12:
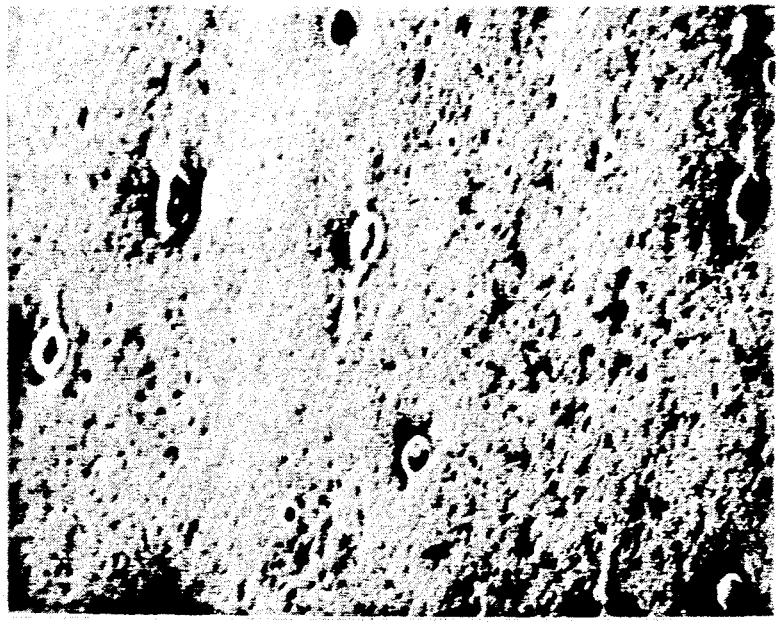
FIGS. 12–14 are photomicrographs, respectively at 100X, 300X and 600X magnification, of a control 18 PT clay coated paperboard in accordance with Examples I–II.
Figure 13:
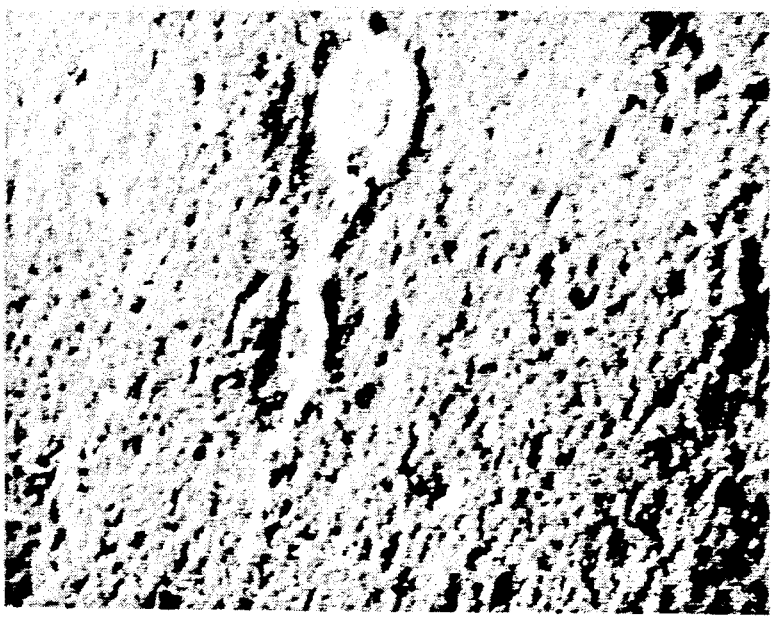
Figure 14:
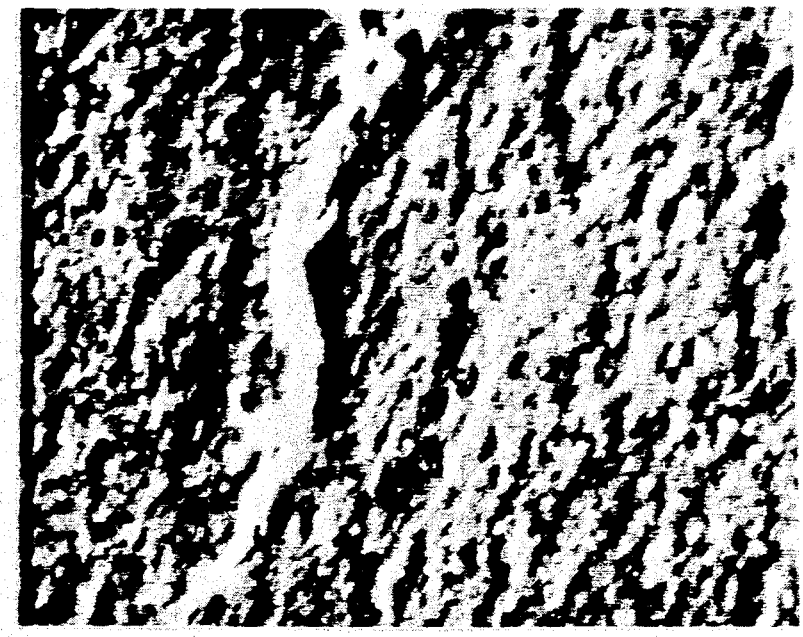

FIGS. 12-14 are photomicrographs, respectively at 100X, 300X and 600X magnification, of a control 18 PT clay coated paperboard coated with the No. 2 clay formulation of the invention. Standard draw down procedures were employed in control trials except that a release film was not used to enhance paperboard gloss.

In Examples I and II an 18 PT paperboard samples were coated with the clay formulation and processed employing 7 and 10 mil MYLAR polyester release films. See FIGS. 11A and B which, respectively, illustrate surface characteristics of 7 and 10 mil MYLAR polyester film at 100X magnification.

Figure 15:
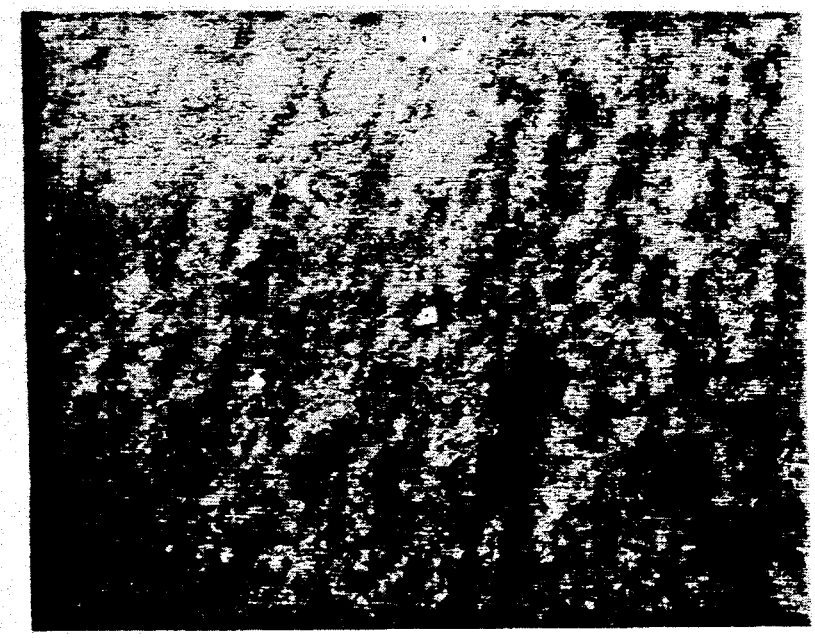
FIGS. 15–17 are photomicrographs of 18 PT clay coated paperboard, respectively at 100X, 300X and 600X magnification, in accordance with Example I employing a 7 mil MYLAR polyester release film.
Figure 16:
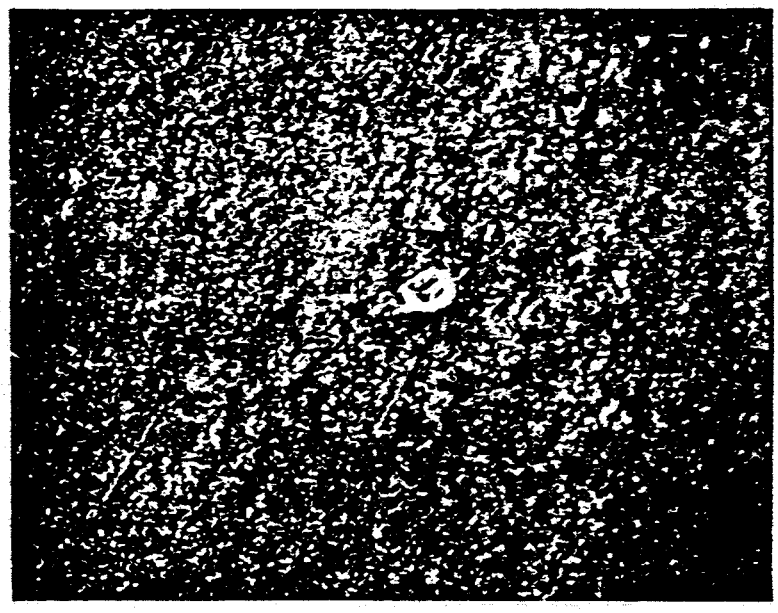
Figure 17:
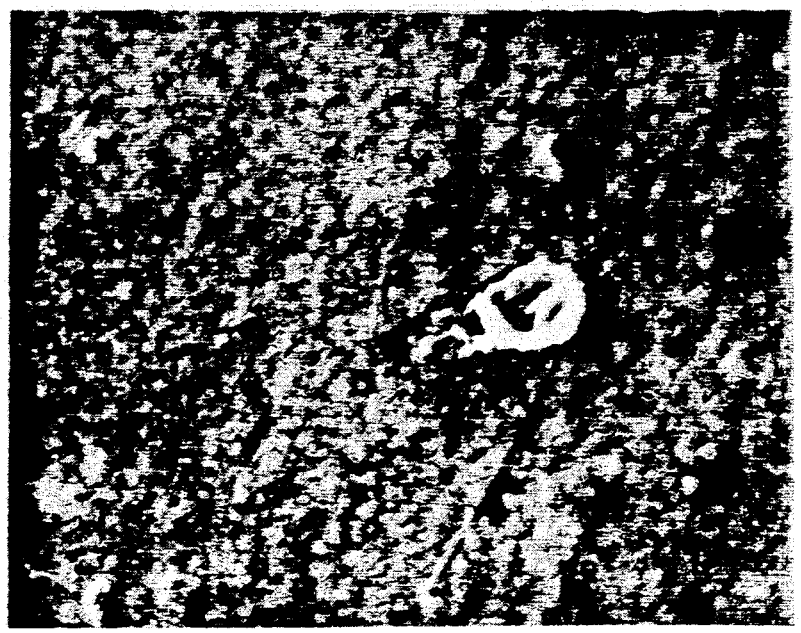
Figure 18:
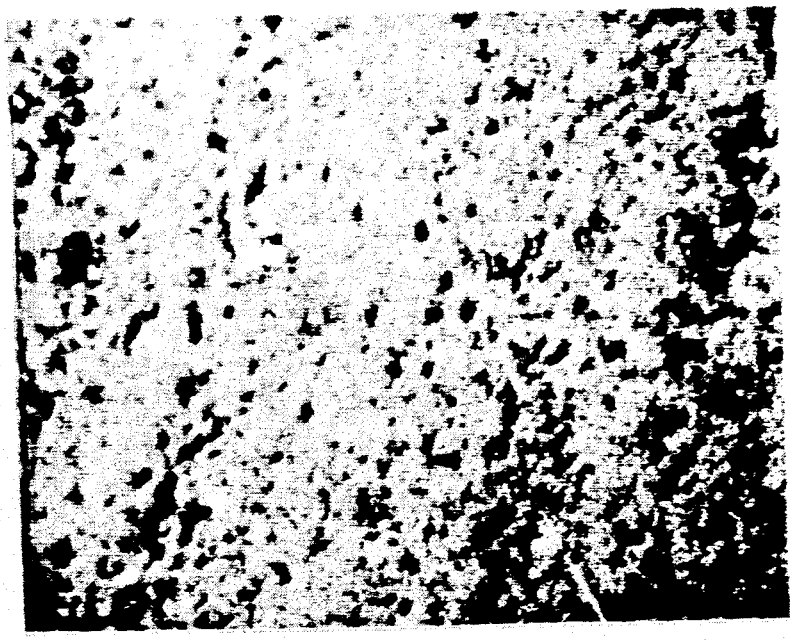
FIGS. 18–20 are photomicrographs of 18 PT clay coated paperboard, respectively at 100X, 300X and 600X magnification, in accordance with Example II employing a 10 mil MYLAR polyester release film.
Figure 19:
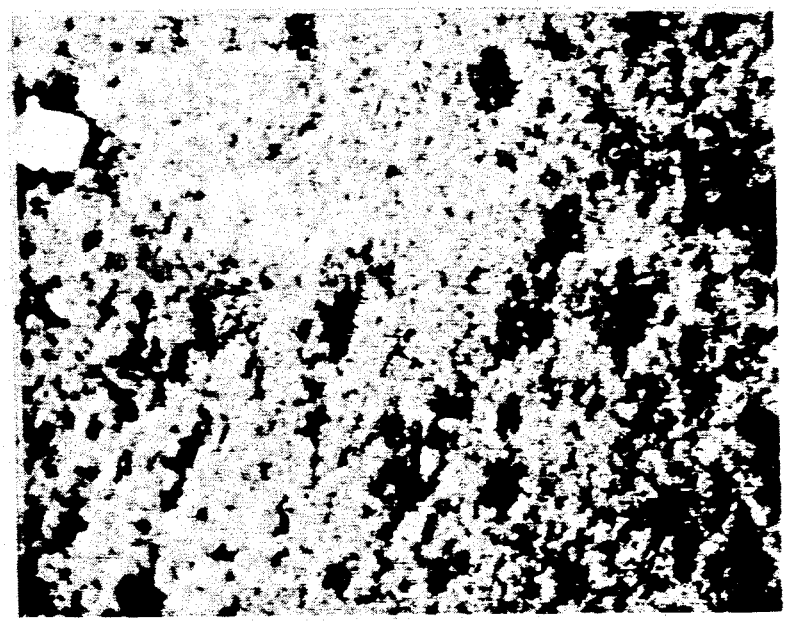
Figure 20:
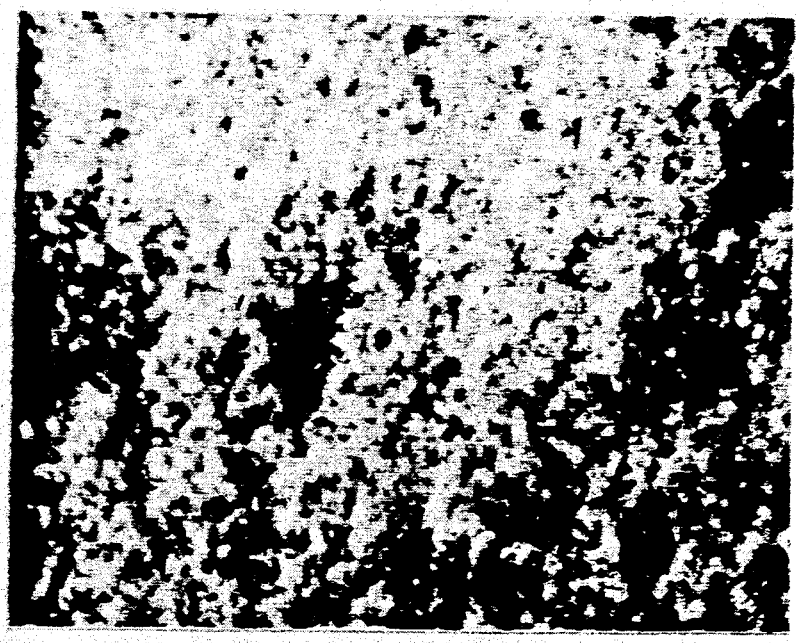

FIGS. 15-17 are photomicrographs, respectively at 100X, 300X and 600X magnifications, of the coated paperboard of Example I as processed with a 7 mil MYLAR polyester film. FIGS. 18-20 are photomicrographs, similar to FIGS. 15-17, of paperboard processed in Example II employing 10 mil MYLAR polyester film.

Figure 21:
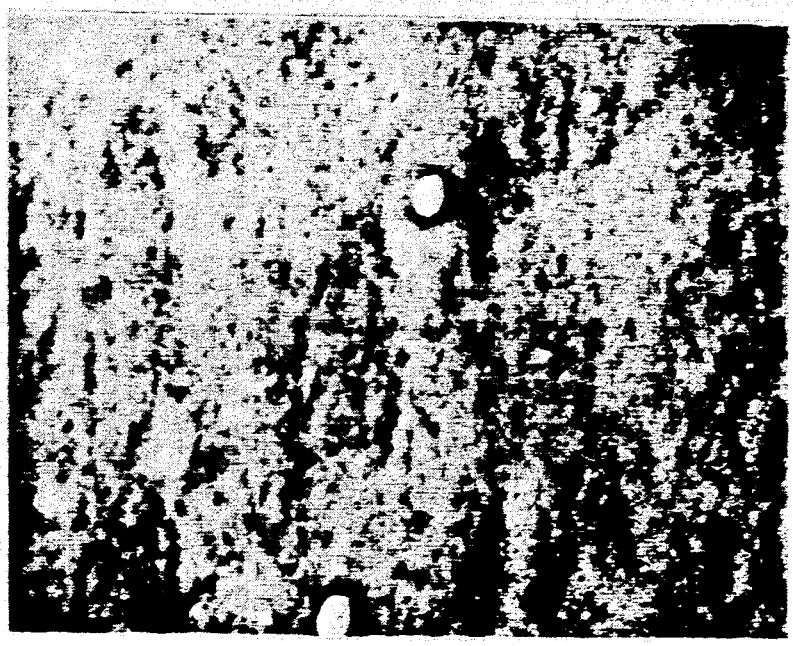
FIGS. 21–23 are photomicrographs of 12 PT clay coated paperboard, respectively at 100X, 300X and 600X magnification, in accordance with Example II employing a 10 mil MYLAR polyester release film.
Figure 22:
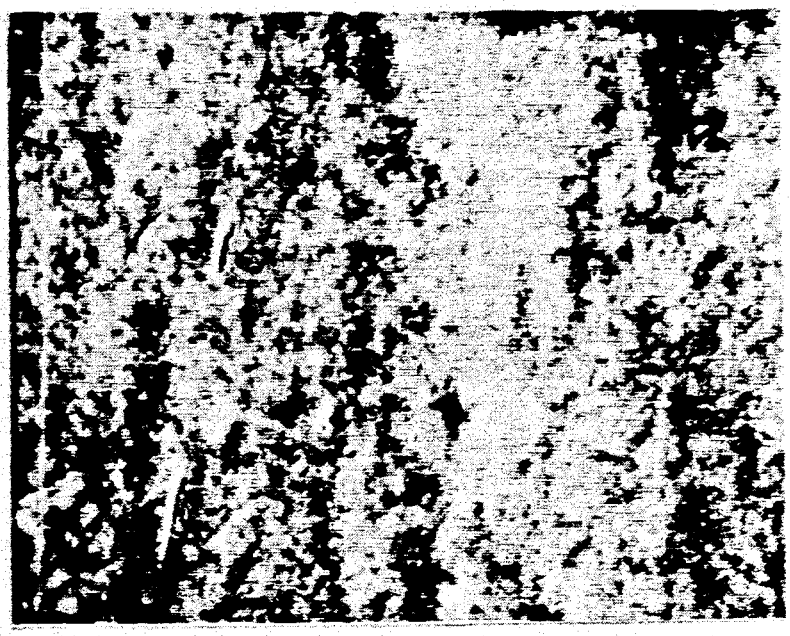
Figure 23:
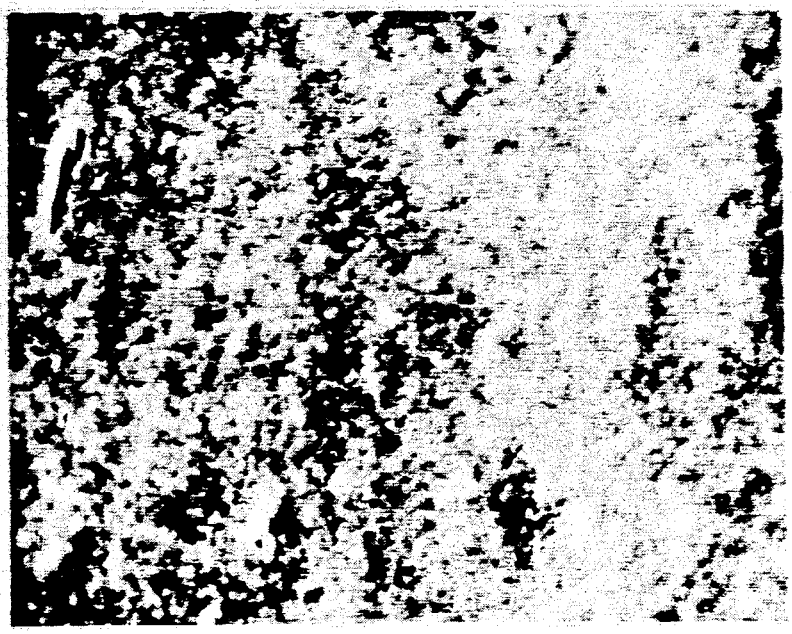

Example III, as illustrated in photomicrographs of FIGS. 21-23, differs from Examples I and II in the use of a 12 PT paperboard which was processed employing a 10 mil MYLAR polyester film.

Comparison of the control and processed paperboards shows a marked enhancement in gloss. Compare control (FIGS. 12-14) to processed paperboard (FIGS. 15-23). Attention is directed to photomicrographs of Example I (FIGS. 15-17) which yielded superior results. Processing of paperboard in accordance with the invention effectively transferred surface characteristics of the MYLAR polyester film (FIG. 11A) to the Example II paperboard (FIGS. 15-17).

Bench top coater and draw down trials demonstrated the efficacy of the invention as applied to the gloss enhancement of clay-coated paperboard. Very high gloss levels were achieved (above 90%), and smoothness was also markedly improved without requirement of calendering. Gloss enhancement in the trials had a direct correlation to smoothness of the release film. All polymer films tested were quite smooth and yielded high gloss characteristics. Conversely, release films which were less smooth (those made from polymer-coated papers) did not significantly enhance gloss. Coating release correlated with the paper or board contact angle. Films having contact angles of 90° or more yielded good release properties. Films with lower contact angles (approximately 70°), obtained excessive sticking of the coating during drying. Of the release films tested, TEFZEL fluoropolymer and MYLAR polyester were the most satisfactory in that they yielded the required high gloss and were the most trouble-free to run under a variety of operating conditions.

Figure 10:
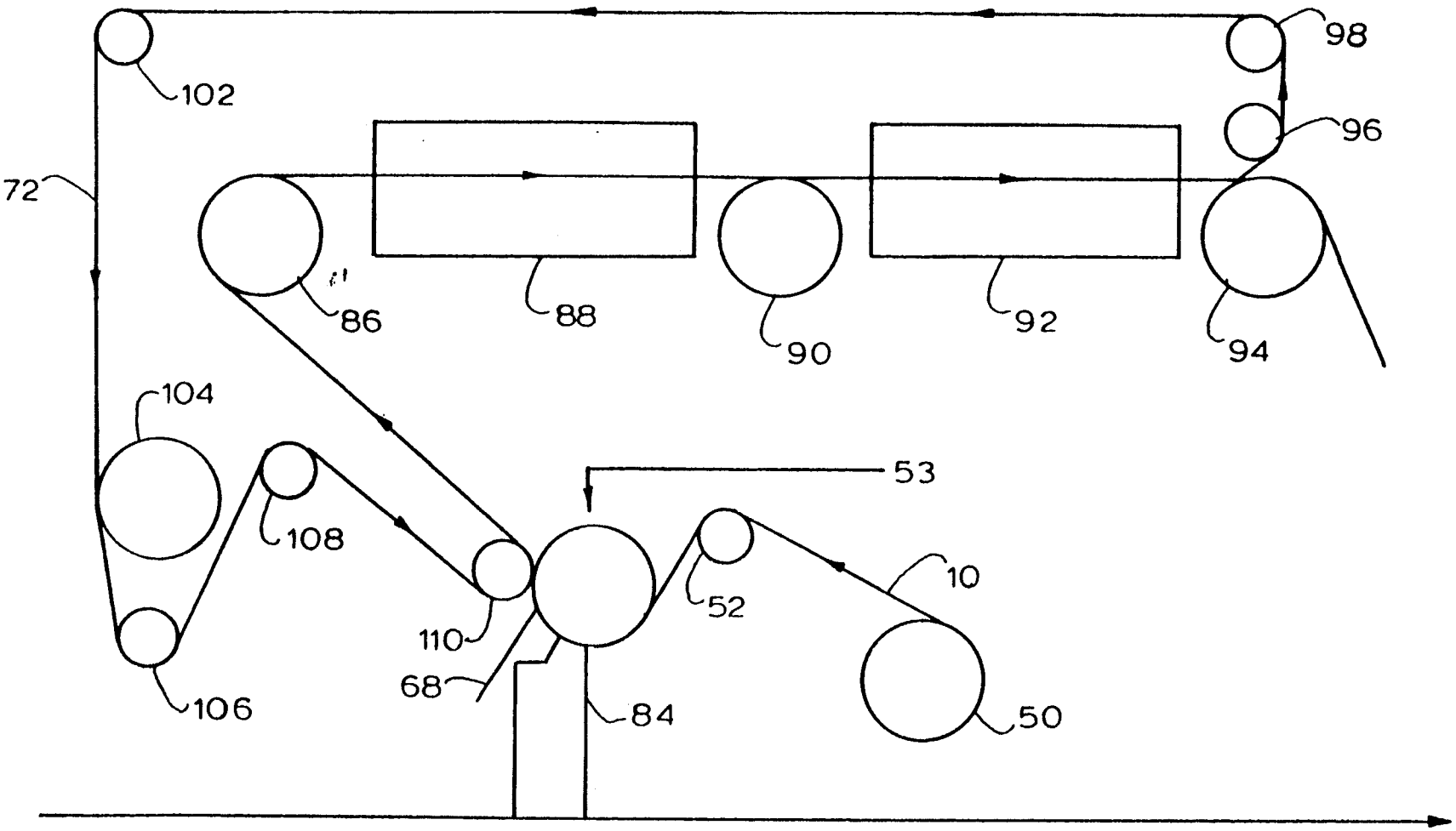
FIG. 10 is a schematic view of a pilot coater adapted in accordance with the invention.
Figure 11A:
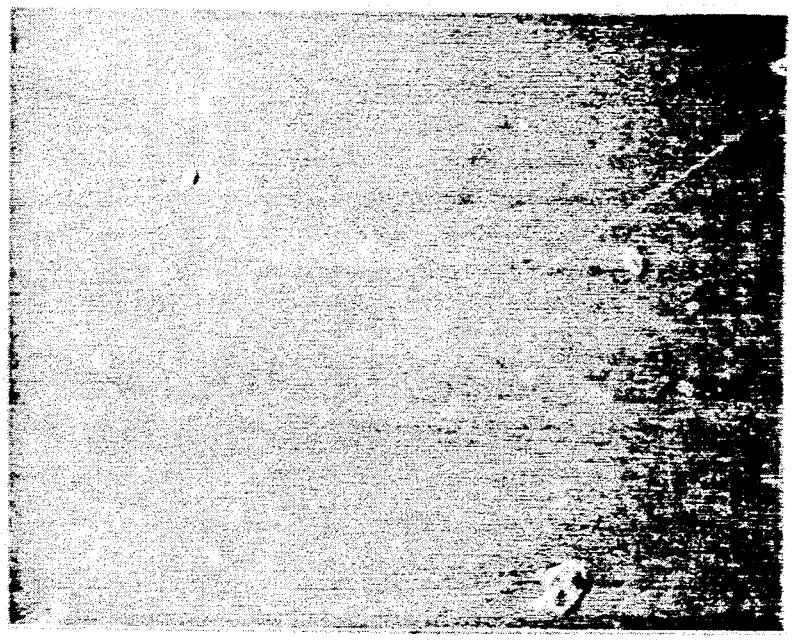
FIGS. 11A and B are photomicrographs of 7 and 10 mil MYLAR at a magnification of 100X.
Figure 11B:
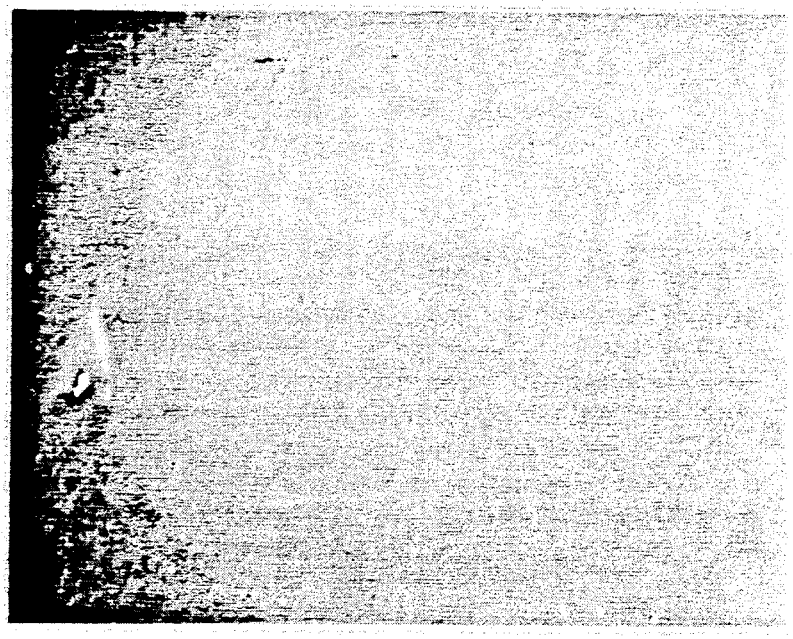

During additional testing of the invention, two release films in the form of a belt were installed on a 36-inch pilot coater. The initial installation employed a belt fabricated of a laminate of TEFLON fluorocarbon and glass cloth. Suitable laminates of this of this type are offered by Norton Company, Wayne, N.J. The second installation utilized TEFLON-coated KAPTON polyamide as the belt material. Both belts were butt spliced with 12-inch-wide pressure-sensitive tape. FIG. 10 is a diagram of the machine set-up for this embodiment of the invention.

As can be seen in FIG. 10, the belt 72 travels on rolls 86, 90, 96, 98, 102, 104, 106, 108 and 110. The substrate 10 is unwound from supply roll 50, travels on rolls 52, 53, 110, 86 and 90, and is wound up on wind-up roll 94. As substrate 10 passes through the application station 84, a layer of clay material is applied thereon. At roll 110, the substrate is wet laminated to the belt 72, whereby the clay coating contacts the belt 72. Thereafter, the lamination enters oven 88 and then oven 92, where the substrate is dried. The dry coated substrate is released from the belt 72 upon exiting oven 92, the coated substrate continues to wind up on roll 94 and the belt traversing above the ovens via roll 96. Movement of the substrate was accomplished by roll 53, which also advances the belt through the nip. The coated substrate which results has a glossy coating surface to which the texture of the release film has been substantially imparted during drying.

From the foregoing it will be appreciated that the invention achieves the results stated above. Gloss enhancement of paper and paperboard is obtained by an apparatus and process of simple design which depart from prior art approaches. The invention advances the art by recognizing that superior gloss enhancement can be obtained under controlled process conditions by employing a polymer release film to set or cure coatings on paper and paperboard. An apparatus line is disclosed which permits production line efficiencies not obtained in the prior art.

Numerous modifications are possible in light of the above disclosure. For example, although the preferred process of the inventions provides for the application of a clay coating on substrate for gloss processing, it is also within the scope of the invention to provide a substrate which includes a deformable layer of coating. A coated substrate of this type could be processed with the film release of the invention by use of deforming agents such as steam or solvents.

Similarly, although only two polymer release films, e.g., the Norton belt (TEFLON laminated to glass cloth) and the Du Pont belt (TEFLON-coated KAPTON) are disclosed herein, it will be recognized that other release film materials may be employed provided they have the required surface characteristics, release properties and heat resistance. For example, an additional investigation is in progress that will permit the use of MYLAR film (which is more economical) by modification of the color or accomplishing release by mechanical means.

Finally, the preferred embodiments are directed to coating paper and paperboard with clay formulations and polyethylene. It will be recognized that the invention has application for other impressionable coatings which are self-supporting when applied to the paper.

Therefore, although the invention has been described with reference to certain preferred embodiments, it will be appreciated that other embodiments of the invention may be devised, which are nevertheless within the scope and spirit of the invention as defined in the claims appended hereto.

TABLE I

| Gloss Enhancement of PE-Coated Board: Extrusion Coater Operating Data | | | | | | | | |
|---|---|---|---|---|---|---|---|---|
| Basestock* | Milk Carton | | VAL-U-COAT ® | | | | Milk Carton | |
| Side Coated | Top (Outside) | | Clay | | | | Top | |
| Sample (Run) No. | 9608-2 | 9608-1 | 9853 | 9854 | 9855 | 9856 | 9857 | 9858 |
| Release Film Used** | Yes | No | Yes | No | No | No | Yes | No |
| Type | (1 mil OPP) | (Control) | (1 mil OPP/PVDC) | (Control) | (Control) | (Control) | (1 mil OPP/PVDC) | (Control) |
| Side next to PE | OPP | — | OPP | — | — | — | OPP | — |
| PE Coating Resin Used | Polyethelene | Polyethelene | | Polyethelene | | | Polyethelene | |
| Brand Designation: TENITE | | | | | | | | |
| Supplier: Eastman Kodak Co., Rochester, N.Y. | | | | | | | | |
| Extruder Settings (°F.) | | | | | | | | |
| Barrel Zone 1 | 400 | | | 400 | | | 400 | |
| Barrel Zone 2 | 475 | | | 475 | | | 475 | |
| Barrel Zone 3 | 550 | | | 550 | | | 550 | |
| Barrel Zone 4 | 600 | | | 600 | | | 600 | |
| Barrel Zones 5–6 | 620 | | | 620 | | | 620 | |
| Head, Adapter | 620 | | | 620 | | | 620 | |
| Target Coating Wt. lb/3000 ft$^2$ | 12 | 12 | 2.2 | 6.0 | 7.2 | 6.0 | 12.0 | 12.0 |
| Chill Roll | | | | | | | | |
| Finish | 50% Gloss Roll | | | 50% Gloss Roll | | | 50% Gloss Roll | |
| Water, °C. | 21 | | | 21 | | | 21 | |
| Coater | | | | | | | | |
| Speed, fpm | 600 | | | 600 | | | 600 | |
| Air-gap, in. | 7 | | | 7 | | | 7 | |
| Blow dryer | Yes | | | Yes | | | Yes | |
| Adhesion Promoter Polyethelene Amine | Yes | | | Yes | | | Yes | |
| Brand Designation: ADCOTE | | | | | | | | |
| Supplier: Martin Chemical Co., Chicago, IL. | | | | | | | | |
| Electrostatic (Corona) Treatment | Off | | | Off | | | Off | |

*VAL-U-COAT is a registered trademark of International Paper Company, Purchase, New York.
**OPP - Oriented Polypropylene
PVDC - Polyvinylidine Chloride

TABLE II

| Gloss Enhancement of PE-Coated Board: Physical Tests on Samples | | | | | | | | |
|---|---|---|---|---|---|---|---|---|
| Basestock | Milk Carton | | VAL-U-COAT ® | | | | Milk Carton | |
| Sample (Run) No. | 9608-2 | 9608-1 | 9853 | 9854 | 9855 | 9856 | 9857 | 9858 |
| Release Film Used | Yes | No (Control) | Yes | Yes | No (Control) | No (Control) | Yes | No (Control) |
| PE Coat Wt., lb/3000 ft$^2$ | 12 | 12 | 7.3 | 5.6 | 7.1 | 6.1 | 10.9 | 10.9 |
| Gloss, Gardner, 75°, % | 92 | 52 (less glossy) | 90 | 91 | 54 | 55 | 81 | 50 |
| Smoothness, Parker Values 5 kg/cm$^2$, μm | 2.3 | 3.0 (less smooth) | 1.9 | 2.6 | 2.9 | 2.5 | 3.1 | 3.6 |
| Kinetic Coefficient of Friction | | | | | | | | |
| PE to Steel | 0.2 | 0.1 | 0.4 | 0.4 | 0.3 | 0.3 | 0.4 | 0.3 |
| PE to Paper | — | — | 0.3 | 0.3 | 0.3 | 0.3 | 0.4 | 0.3 |
| PE to PE | 0.4 | 0.2 | 0.6 | 0.6 | 0.4 | 0.4 | 0.6 | 0.4 |
| Static Coefficient of Friction | | | | | | | | |
| PE to Steel | 0.2 | 0.1 | 0.5 | 0.4 | 0.3 | 0.3 | 0.4 | 0.3 |
| PE to Paper | — | — | 0.4 | 0.4 | 0.3 | 0.4 | 0.4 | 0.3 |
| PE to PE | 0.5 | 0.2 | 0.7 | 0.6 | 0.5 | 0.5 | 0.6 | 0.4 |

TABLE III

| PROPERTIES OF POLYMER FILMS USED FOR GLOSS ENHANCEMENT | | | | | | | |
|---|---|---|---|---|---|---|---|
| FILM-Brand Designation* | MYLAR | | SILAR | | KAPTON | | TEFZEL |
| Type: | (Polyester) | | (Silicone Coated Mylar) | | (Polyimide) | | (Fluoro-polymer) |
| Caliper, mils: | 7 | 10 | 3 | 5 | 2 | 5 | 10 |
| SMOOTHNESS: | | | | | | | |
| Profilometer Smoothness Number | 4 | 1 | 3 | 2 | 3 | 3 | 3 |
| Parker Print Surf. (5 kg/cm$^2$), μm | 4 | 7 | 2 | 2 | 2 | 2 | 4 |
| Gloss, Gardner (75°), % | 99 | 100 | 100 | 100 | 100 | 100 | 100 |
| RELEASE PROPERTIES: | | | | | | | |
| Lab Drawdown Observations | Poor | Poor | Good | Good | Poor | Poor | Good |
| Bench Top Coating Observations | Poor | Poor | Good | Good | Poor | Poor | Good |
| Contact Angle | 68 | 72 | 88 | 87 | 71 | 72 | 93 |

TABLE III-continued

PROPERTIES OF POLYMER FILMS USED FOR GLOSS ENHANCEMENT

| | | | | | | | | |
|---|---|---|---|---|---|---|---|---|
| (Dist. water °) | | | | | | | | |
| HEAT RESISTANCE: | | | | | | | | |
| Melting Point, °C. | | 260 | 260 | 260 | 260 | 360 | 360 | 270 |
| Max Service Temp., °C. | | 150 | 150 | 150 | 150 | 260 | 260 | 205 |
| TOUGHNESS (PHYS. PROPS.):** | | | | | | | | |
| Tensile, lb/in | MD | 220 | 238 | 92 | 124 | 64 | 164 | 78 |
| | CD | 160 | 211 | 74 | 111 | 58 | 145 | 67 |
| Stretch, % | MD | 88 | 135 | 90 | 95 | 43 | 54 | 325 |
| | CD | 114 | 162 | 100 | 110 | 51 | 57 | 425 |
| TEA, in.-lb/in$^2$ | MD | 153 | 103 | 64 | 94 | 22 | 69 | 112 |
| | CD | 145 | 115 | 59 | 96 | 23 | 66 | 130 |
| MOE, lb/in$^2$ × 10$^6$ | MD | 0.6 | 0.5 | 0.8 | 0.7 | 0.2 | 0.5 | — |
| | CD | 0.5 | 0.4 | 0.6 | 0.6 | 0.2 | 0.4 | — |
| Tear, g | MD | 76 | 346 | 36 | 59 | 25 | 55 | Too Strong |
| | CD | 98 | 532 | 55 | 90 | 24 | 59 | Too Strong |
| Stiffness, Taber, | MD | 18 | 41 | 1 | 1 | 0.2 | 0.3 | 20 |
| g-cm | CD | 14 | 41 | 6 | 5 | 6 | 6 | 17 |
| Fold, MIT | MD | 3000 | 3000 | 3000 | 3000 | 3000 | 3000 | 3000 |
| | CD | 3000 | 3000 | 3000 | 3000 | 3000 | 3000 | 3000 |

| FILM-Brand Designation* | | TEFLON (Fluoro-carbon) | | TPX (Trimethyl-Pentane) | SCOTCHBAN (Telfon Coated Paper) | 84 C1S (PE & Silicone Coated Paper) |
|---|---|---|---|---|---|---|
| Type: | | | | | | |
| Caliper, mils: | | 2 | 10 | 5 | 4.5 | 6 |
| SMOOTHNESS: | | | | | | |
| Profilometer Smoothness Number | | 4 | 3 | 3 | 6 | 5 |
| Parker Print Surf. (5 kg/cm$^2$), μm | | 1 | 2 | 3 | 3 | 6 |
| Gloss, Gardner (75°), % | | 100 | 100 | 100 | 83 | 53 |
| RELEASE PROPERTIES: | | | | | | |
| Lab Drawdown Observations | | Good | Good | Good | Good | Good |
| Bench Top Coating Observations | | Good | Good | Good | Good | Fair |
| Contact Angle (Dist. water °) | | 93 | 87 | 98 | 106 | 85 |
| HEAT RESISTANCE: | | | | | | |
| Melting Point, °C. | | 265 | 265 | 230 | — | — |
| Max Service Temp., °C. | | 205 | 205 | 100 | 115 | 150 |
| TOUGHNESS (PHYS. PROPS.):** | | | | | | |
| Tensile, lb/in | MD | 7 | 38 | 16 | 50 | 49 |
| | CD | 7 | 37 | 15 | 24 | 23 |
| Stretch, % | MD | 256 | 261 | 8 | 4 | 3 |
| | CD | 403 | 402 | 14 | 6 | 5 |
| TEA, in.-lb/in$^2$ | MD | — | 113 | 1 | 1 | 1 |
| | CD | — | 110 | 2 | 1 | 1 |
| MOE, lb/in$^2$ × 10$^6$ | MD | — | — | — | 0.3 | 0.3 |
| | CD | — | — | — | 0.03 | 0.02 |
| Tear, g | MD | 201 | 228 | 272 | 54 | 94 |
| | CD | 1300 | 1350 | 1700 | 59 | 114 |
| Stiffness, Taber, | MD | — | 7 | 1 | 3 | 13 |
| g-cm | CD | — | 7 | 1 | 3 | 9 |
| Fold, MIT | MD | 3000 | 3000 | 3000 | 1200 | 200 |
| | CD | 3000 | 3000 | 3000 | 500 | 40 |

*MYLAR, KAPTON, TEFZEL and TEFLON are trademarks of E. I. DuPont de Nemours and Company, Wilmington, Delaware.
SILAR a trademark of Coating & Laminating Co.
TPX is a trademark of Westlake Plastic Company, Lenni, Pennsylvania.
SCOTCHBAN and 84 C1S are trademarks of Thilmany Pulp and Paper Company, Kaukauna, Wisconsin.
**TEA - Tensile energy absorption
MOE - Modules of elasticity
MIT Fold - TAPPI - 511 dm-83
Taber Stiffness - TAPPI - 489 os-76

TABLE IV

PROPERTIES OF POLYMER FILMS USED FOR GLOSS ENHANCEMENT; SUMMARY OF RESULTS

| POLYMER FILM: | SMOOTHNESS | RELEASE PROPERTIES | HEAT RESISTANCE | TOUGNESS |
|---|---|---|---|---|
| KAPTON (Polyimide) | Good | Poor | Good | Fair |
| MYLAR (Polyester) | Good | Poor | Fair | Good |
| TEFLON (Fluorocarbon) | Good | Good | Good | Fair |
| TEFZEL (Fluoro polymer) | Good | Good | Good | Good |
| TPX (Tri-methyl Pentane) | Good | Fair | Good | Fair |
| C1S MYLAR (Silicone Coated Mylar) | Good | Good | Fair | Good |
| SCOTCHBAN (Fluorocarbon Coated Paper) | Fair | Good | Fair | Fair |
| THILMANY 84 C1S (Silicone Coated Paper) | Fair | Fair | Fair | Fair |

TABLE V

BENCH TOP COATER TRIALS USING BELTS OF VARIOUS POLYMER FILMS TO ENHANCE GLOSS

| | MACHINE OPERATING PARAMETERS | | PHYSICAL TESTS OF COATED PAPER | | |
|---|---|---|---|---|---|
| POLYMER FILM USED AS BELT: | Speed fpm | Coating Blade Loading g | Clay Pick-up lb/3000 ft$^2$ | Smoothness Parker, 5 kg, μm | Gloss Gardner, 5 |
| MYLAR, 10 mil, Type A | Various | Various | Excessive | Sticking | (98) |
| SILAR, | | | | | |
| 3 mil | 15 | 1500 | 13 | 0.9 | 95 |
| 5 mil | 15 | 1500 | 18 | 1.0 | 94 |
| KAPTON | Various | Various | Excessive | Sticking | |
| TEFZEL | 15 | 500 | 21 | 1.2 | 95 |
| | | 1000 | 13 | 1.2 | 94 |
| | | 1500 | 11 | 1.1 | 94 |
| | | 1500 | 10 | 1.0 | 93* |
| | 20 | 500 | 24 | 1.2 | 91 |
| | | 1000 | 14 | 0.9 | 89 |
| | | 1500 | 10 | 1.7 | 90 |
| | 25 | 1000 | 17 | 1.2 | 91 |
| | | 1500 | 11 | 1.2 | 90 |
| TEFLON, 2 mil | 15 | 1500 | 13 | 1.7 | 96 |
| TPX | 15 | 1500 | 15 | 1.1 | 92 |
| SCOTCHBAN | 15 | 1500 | 15 | 2.3 | 73 |
| 84-LB C2S | 15 | 1500 | 18 | 3.8 | 52 |
| CONTROL (No Film Used) | 15 | 1500 | 5 | 4.0 | 23* |
| | 20 | 1000 | 6 | 3.8 | 25* |
| | 40 | 250 | 10 | 8.2 | 10 |
| | 40 | 250 | 10 | 1.7 | 63* |

*These samples were calendered.

We claim:

1. An apparatus for producing a paper product having a surface with enhanced gloss, comprising:

an uncoated release film having a smooth surface;

means for applying a continuous layer of deformable coating material on a moving substrate prior to being brought into contact with said uncoated release film;

means for solidifying said layer of deformable coating material, said solidifying means having a zone in which the solidification occurs;

means for placing said substrate with said layer of coating material applied thereon within said zone; and means for contacting said layer of coating material with said smooth surface of said release film while said layer of coating material is within said zone, said release film being brought into contact with said layer of coating material at a location at which said layer of coating material is being carried by said moving substrate;

wherein said smooth surface of said release film has a gloss which is substantially equal to or greater than 99%, is substantially free of defects, has on-adhering and release characteristics, and has a film-coating contact angle which is equal to or greater than 87 degrees, said smooth surface of said release film imparting a gloss of at least 90% to the surface of said solidified layer of coating material.

2. The apparatus as defined in claim 1, wherein said coating material comprises a polymer, said applying means comprises an extruder, and said solidifying means comprises a chill roll.

3. The apparatus as defined in claim 2, wherein said polymer is polyethylene.

4. The apparatus as defined in claim 2, wherein said contacting means comprises means for unwinding a roll of said release film and means for winding up said release film after unwinding by said unwinding means.

5. The apparatus as defined in claim 4, wherein said placing means comprises means for unwinding a roll of said substrate and means for winding up said substrate after said layer of coating material applied thereon has been cured.

6. The apparatus as defined in claim 5, wherein said means for unwinding and winding comprises rotatable rolls.

7. The apparatus as defined in claim 2, wherein said contacting means comprises belt means supported by rolling means.

8. The apparatus as defined in claim 7, wherein said placing means comprises means for unwinding a roll of said substrate and means for winding up said substrate after said layer of coating material applied thereon has been solidified.

9. The apparatus as defined in claim 7, wherein said belt means comprises a belt and said rolling means comprises first and second rolls, each of said first and second rolls supporting said belt.

10. The apparatus as defined in claim 7, wherein said belt means comprises a belt and said rolling means comprises a roll, said belt being wrapped securely around said roll.

11. The apparatus as defined in claim 1, wherein said substrate comprises a paperboard web.

12. The apparatus as defined in claim 1, wherein said coating material comprises a clay formulation, said applying means comprises an applicator roll and a metering device, and said solidifying means comprises a source of heat.

13. The apparatus as defined in claim 12, wherein said contacting means comprises means for unwinding a roll of said release film and means for winding up said release film after unwinding by said unwinding means.

14. The apparatus as defined in claim 13, wherein said placing means comprises means for unwinding a roll of said substrate and means for winding up said substrate after said layer of coating material applied thereon has been solidified.

15. The apparatus as defined in claim 14, wherein said means for unwinding a roll of said release film, said means for winding up said release film, said means for unwinding a roll of said substrate, and said means for winding up said substrate each comprise a roll.

16. The apparatus as defined in claim 12, wherein said contacting means comprises belt means supported by rolling means.

17. The apparatus as defined in claim 16, wherein said belt means comprises a belt and said rolling means comprises first and second rolls, each of said first and second rolls supporting said belt.

18. The apparatus as defined in claim 16, wherein said belt means comprises a belt and said rolling means comprises a roll, said belt being wrapped securely around said roll.

19. The apparatus as defined in claim 16, wherein said placing means comprises means for unwinding a roll of said substrate and means for winding up said substrate after said layer of coating material applied thereon has been solidified.

20. The apparatus as defined in claim 1, wherein said release film comprises oriented polypropylene.

21. The apparatus as defined in claim 1, wherein said release film comprises fluorocarbon.

22. The apparatus as defined in claim 1, wherein said release film comprises fluoropolymer.

23. The apparatus as defined in claim 1, wherein said release film comprises tri-methyl pentane.

24. The apparatus as defined in claim 1, wherein said release film comprises silicone-coated polyester.

* * * * *

UNITED STATES PATENT AND TRADEMARK OFFICE

CERTIFICATE OF CORRECTION

PATENT NO. : 5,328,510

DATED : July 12, 1994

INVENTOR(S) : Leroy C. Hofmann et al.

It is certified that error appears in the above-identified patent and that said Letters Patent is hereby corrected as shown below:

In column 4, line 14, change "Polyethylene" to —polyethylene—;

in column 4, line 51, change "Example II" to —Example III—;

In column 7, line 3, insert a period after "belts";

In column 7, line 4, insert a period after "8";

In claim 1, column 17, line 50, change "on-adhering" to — non-adhering—.

Signed and Sealed this

Thirteenth Day of December, 1994

*Attest:*

Bruce Lehman

BRUCE LEHMAN

*Attesting Officer*

*Commissioner of Patents and Trademarks*